United States Patent [19]

Allebone

[11] 4,325,039

[45] Apr. 13, 1982

[54] LEAKY COAXIAL CABLE WHEREIN APERTURE SPACINGS DECREASE ALONG THE LENGTH OF THE CABLE

[75] Inventor: Brian H. Allebone, Chester, England

[73] Assignee: BICC Limited, London, England

[21] Appl. No.: 201,567

[22] Filed: Oct. 28, 1980

[30] Foreign Application Priority Data

Oct. 31, 1979 [GB] United Kingdom ..... 37616/79

[51] Int. Cl.[3] ..... H01P 3/06

[52] U.S. Cl. ..... 333/237; 29/828

[58] Field of Search ..... 333/237, 113, 115; 174/102 SP; 343/771

[56] References Cited

U.S. PATENT DOCUMENTS 2,654,842 10/1953 Engelmann ..... 333/237 X
3,990,079 11/1976 Epis ..... 343/771
4,157,518 6/1979 McCarthy ..... 333/237

FOREIGN PATENT DOCUMENTS 1272878 5/1972 United Kingdom .

*Primary Examiner*—Paul L. Gensler
*Attorney, Agent, or Firm*—Buell, Blenko, Ziesenheim & Beck

[57] ABSTRACT

The outer conductor of a high frequency electric cable of the kind employed as a stationary elongate element for transmitting high frequency signals to, or receiving high frequency signals from a receiving or transmitting device carried by a mobile body, has extending along its length at least one row of mutually spaced apertures, the mutual spacing between adjacent apertures of the or each row decreasing along the length of the row, being a maximum value at one end of the row and a minimum value at the other end of the row. The or each row of apertures may be sub-divided into a plurality of sub-groups of apertures, the mutual spacing between adjacent apertures of each sub-group being constant, and the mutual spacing between adjacent sub-groups decreasing along the length of the cable.

8 Claims, 3 Drawing Figures

LEAKY COAXIAL CABLE WHEREIN APERTURE SPACINGS DECREASE ALONG THE LENGTH OF THE CABLE

This invention relates to high frequency electric cables of the kind employed as a stationary elongate element for transmitting high frequency signals to, or receiving high frequency signals from, a receiving or transmitting device carried by a mobile body, for instance a vehicle or person, which may be in the open air, in a building or underground, for instance in a tunnel, mine or similar enclosure where signals radiated from a point source are rapidly attentuated, or employed in a system for detecting the presence of a person, vehicle or other mobile body in an area which is in the open air or in a building and which is under surveillance.

It is an object of the present invention to provide an improved high frequency coaxial cable of the aforesaid kind which, over a finite length of the cable, will transmit or receive high frequency signals of substantially more uniform signal strength than high frequency cables of the aforesaid kind hitherto proposed and used.

According to the invention, in a high frequency coaxial cable comprising an inner conductor and, insulated from and surrounding the inner conductor throughout the length of the cable, an outer conductor of metal or metal alloy having extending longitudinally throughout at least a finite part of its length at least one row of apertures that are mutually spaced along the outer conductor, each aperture being of such a size and the mutual spacing between adjacent apertures being such that high frequency signals can be received by or transmitted from the cable, the mutual spacing between adjacent apertures of said row decreases along the length of the row, being a maximum value at one end of the row and a minimum value at the other end of the row.

Preferably, the mutual spacing between each pair of adjacent apertures of the row or at least one of the rows of apertures, except the last pair of adjacent apertures whose mutual spacing is said minimum value, is greater than the mutual spacing between one of the neighbouring pairs of adjacent apertures so that the mutual spacing between adjacent apertures of the row decreases throughout the length of the row.

In some instances, the row or at least one of the rows of apertures may be sub-divided along its length into a plurality of sub-groups of apertures, the mutual spacing between adjacent apertures in each sub-group of apertures being substantially constant, and the mutual spacing between each pair of adjacent sub-groups of apertures, except the last pair of adjacent sub-groups of apertures whose mutual spacing is a minimum value, being greater than the mutual spacing between one of the neighbouring pairs of adjacent sub-groups of apertures so that the mutual spacing between adjacent sub-groups of apertures of the row decreases at spaced positions along the length of the row. The substantially constant mutual spacing between adjacent apertures in all of the sub-groups may be the same or, in some cases, the substantially constant mutual spacing between adjacent apertures in each sub-group, except the last sub-group in which the substantially constant mutual spacing between adjacent apertures is a minimum value, may be greater than the substantially constant mutual spacing between adjacent apertures of one of the adjacent sub-groups.

In all cases, preferably the apertures of the or each row are substantially the same shape and size and, in a preferred embodiment, the apertures are of substantially circular form.

The or each longitudinally extending row of apertures is preferably substantially parallel to the longitudinal axis of the cable.

Preferably, the outer conductor is formed of a longitudinally applied, transversely folded tape made wholly or partly of metal or metal alloy, the apertures of the or each row being punched, drilled or otherwise formed in the tape, before the tape is applied to the cable, in such a configuration that when the tape is applied to the insulated inner conductor a longitudinally extending row or longitudinally extending rows of apertures is or are provided in the outer conductor with the desired mutual spacing between the adjacent apertures.

The present invention is especially, but not exclusively, applicable to use in the coaxial cable described and claimed in the Complete Specification of our British Patent No. 1,424,685.

According to another aspect of the invention, the outer conductor of a preferred high frequency coaxial cable is formed by a method which comprises winding a tape made wholly or partly of metal or metal alloy into a convolute coil; at at least one position around the circumference of the coil drilling radially through the adjacent turns of the tape to form an aperture in each turn; and longitudinally applying the tape to, and transversely folding the tape around, the insulated inner conductor of the coaxial cable to form an outer conductor having at least one row of apertures mutually spaced along its length, the mutual spacing between adjacent apertures of said row decreasing along the length of the row and being a maximum value at one end of the row and a minimum value at the other end of the row.

Where the convolute coil is radially drilled at one position only around its circumference, the mutual spacing between each pair of adjacent apertures, except the last pair of adjacent apertures whose mutual spacing is said minimum value, will be greater than the mutual spacing between one of the neighbouring pairs of adjacent apertures, so that the mutual spacing between adjacent apertures of the row decreases throughout the length of the row.

Where the convolute coil is radially drilled in two or more circumferentially spaced positions around its circumference, the row of apertures in the outer conductor will be sub-divided along its length into a plurality of sub-groups of apertures, the mutual spacing between adjacent apertures in each sub-group of apertures being substantially constant and the mutual spacing between adjacent apertures of one sub-group of apertures, except the last sub-group of apertures in which the mutual spacing between adjacent apertures is said minimum value, being greater than the mutual spacing between adjacent apertures of one of the neighbouring sub-groups of apertures, so that the mutual spacing between adjacent apertures of the row changes at spaced positions along the length of the row, and the mutual spacing between adjacent sub-groups of apertures decreasing from one end of the outer conductor to the other.

The improved high frequency coaxial cable of the present invention has the important advantage that the apertured outer conductor is graded to compensate for a gradual decrease in strength of a transmitted or received signal along the cable length due to attenuation.

The invention is further illustrated by a description, by way of example, of two forms of our improved high frequency coaxial cable and of a preferred method of forming the outer conductor of a high frequency coaxial cable, with the reference to the accompanying drawings, in which.

Figure 1:
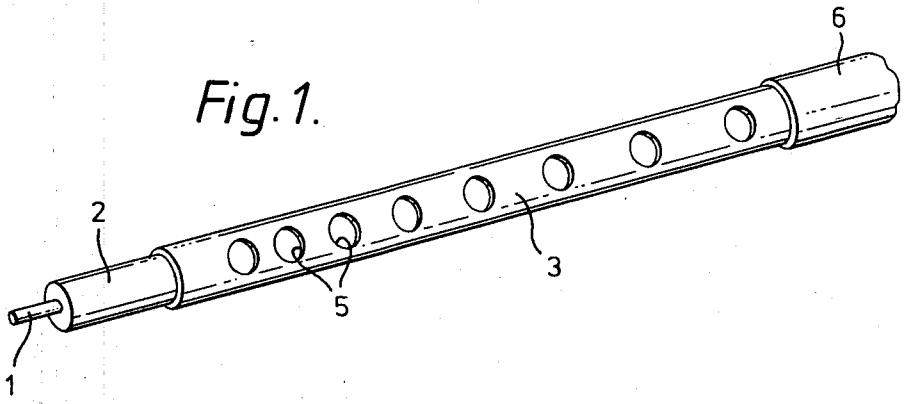
FIG. 1 is a fragmental perspective view of the first form of high frequency coaxial cable.

The high frequency coaxial cable shown in FIG. 1 comprises an inner conductor 1, an extruded layer 2 of plastics insulation, an outer conductor 3 formed of a longitudinally applied, transversely folded metal tape, and an outer plastics sheath 6. The outer conductor 3 has extending throughout its length a single row of circular apertures 5, the mutual spacing between each pair of adjacent circular apertures, except the last pair of adjacent circular apertures whose mutual spacing is a minimum value, being greater than the mutual spacing between one of the neighbouring pairs of adjacent circular apertures so that the mutual spacing between adjacent circular apertures of the row decreases throughout the length of the row.

Figure 2:
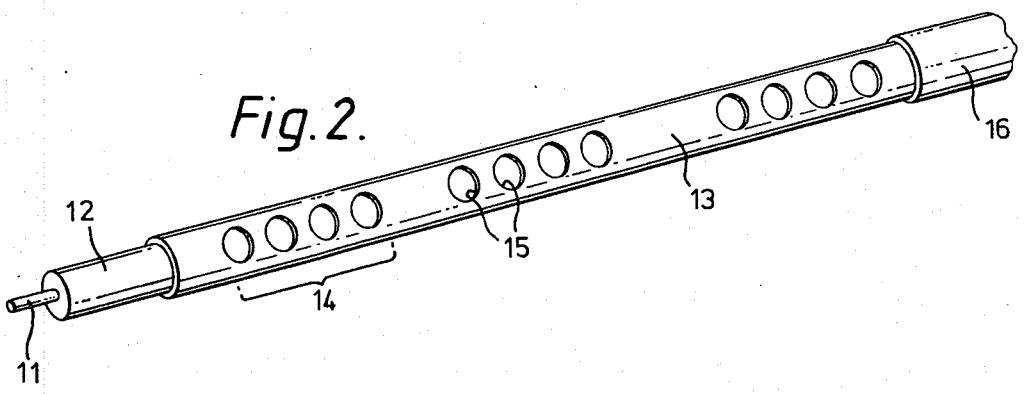
FIG. 2 is a fragmental perspective view of the second form of high frequency coaxial cable.

The second form of high frequency coaxial cable shown in FIG. 2 comprises an inner conductor 11, an extruded layer 12 of plastics insulation, an outer conductor 13 formed of a longitudinally applied, transversely folded metal tape, and an outer plastics sheath 16. The outer conductor 13 has extending throughout its length a single row of circular apertures 15. The row of apertures 15 is sub-divided along its length into a plurality of sub-groups 14 of circular apertures, each sub-group consisting of four circular apertures. The mutual spacing between adjacent apertures in all of the sub-groups is substantially constant and is the same. The mutual spacing between each pair of adjacent sub-groups 14, except the last pair of adjacent sub-groups whose mutual spacing is a minimum value, is greater than the mutual spacing between one of the neighbouring pairs of adjacent sub-groups so that the mutual spacing between adjacent sub-groups of apertures decreases at spaced positions along the length of the row.

Figure 3:
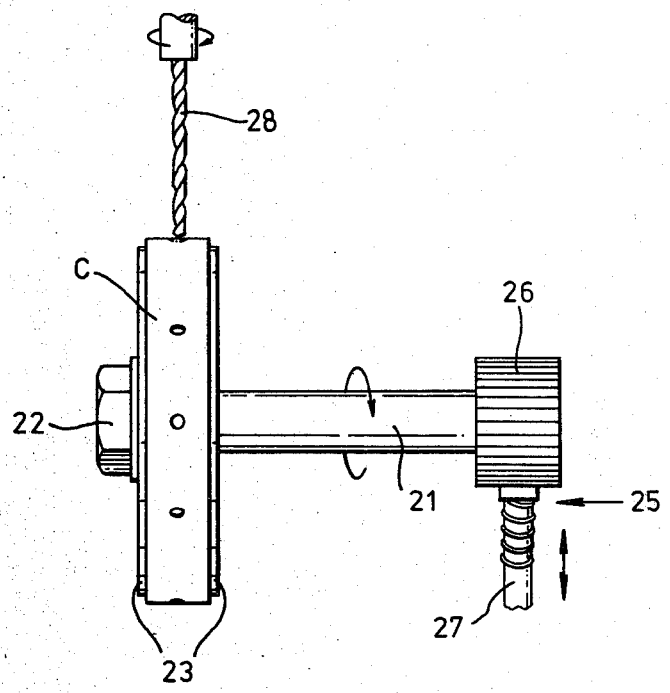
FIG. 3 is a pictorial view of a preferred method of punching holes in a metal tape to be used as the outer conductor of a third form of high frequency coaxial cable.

FIG. 3 shows diagrammatically apparatus for use in a preferred method of making an apertured metal tape for use as the outer conductor of a third form of high frequency coaxial cable. The apparatus comprises a rotatably driven shaft 21 on which is mounted a pair of support plates 23 between which a convolute coil C of metal tape is clamped by means of a bolt 22. Associated with the shaft 21 is indexing mechanism 25 comprising a toothed wheel 26 coaxial with the shaft and a spring-loaded pawl 27 for engaging the toothed wheel 26 to limit the extent of rotation of the shaft 21. A rotatably driven drill 28 is mounted radially with respect to the convolute coil C.

In use, with a convolute coil C of metal tape clamped between the support plates 23, at each of a plurality of uniformly spaced positions around the circumference of the coil, a hole is drilled radially through the adjacent turns of tape to form a circular aperture in each turn. The tape so formed will have a single row of circular apertures extending throughout its length, the row of apertures being sub-divided along its length into a plurality of sub-groups of apertures. The sub-groups of apertures will each consist of the same number of apertures and the mutual spacing between adjacent apertures in each sub-group will be substantially constant. The mutual spacing between adjacent circular apertures of one sub-group, except the last sub-group in which the mutual spacing between adjacent apertures will be of a minimum value, will be greater than the mutual spacing between adjacent apertures of one of the neighbouring sub-groups of apertures, so that the mutual spacing between adjacent apertures of the sub-groups changes at spaced positions along the length of the row. The mutual spacing between adjacent sub-groups of apertures decreases from one end of the metal tape to the other.

To form the outer conductor of a high frequency coaxial cable, the apertured metal tape so formed is applied longitudinally to, and is transversely folded around, the insulated inner conductor of the coaxial cable.

What I claim as my invention is:

1. A high frequency coaxial cable comprising an inner conductor and, insulated from and surrounding the inner conductor throughout the length of the cable, an outer conductor of metal or metal alloy having extending longitudinally throughout at least a finite part of its length at least one row of apertures that are mutually spaced along the outer conductor, each aperture being of such a size and the mutual spacing between adjacent apertures being such that high frequency signals can be received by or transmitted from the cable, wherein the mutual spacing between adjacent apertures of said row decreases along the length of the row, being a maximum value at the end of the row and a minimum value at the other end of the row.

2. A high frequency coaxial cable as claimed in claim 1, wherein the mutual spacing between each pair of adjacent apertures of the row, except the last pair of adjacent apertures whose mutual spacing is said minimum value, is greater than the mutual spacing between one of the neighbouring pairs of adjacent apertures so that the mutual spacing between adjacent apertures of the row decreases throughout the length of the row.

3. A high frequency coaxial cable as claimed in claim 1, wherein the row of apertures is sub-divided along its length into a plurality of sub-groups of apertures, the mutual spacing between adjacent apertures in each sub-group of apertures being substantially constant, and the mutual spacing between each pair of adjacent sub-groups of apertures, except the last pair of adjacent sub-groups of apertures whose mutual spacing is said minimum value, being greater than the mutual spacing between one of the neighbouring pairs of adjacent sub-groups of apertures so that the mutual spacing between adjacent sub-groups of apertures of the row decreases at spaced positions along the length of the row.

4. A high frequency coaxial cable as claimed in claim 3, wherein the substantially constant mutual spacing between adjacent apertures in each sub-group, except the last sub-group in which the substantially constant mutual spacing between adjacent apertures is a minimum value, is greater than the substantially constant mutual spacing between adjacent apertures of one of the adjacent sub-groups.

5. A high frequency coaxial cable as claimed in claim 1, wherein the apertures of the row are substantially the same shape and size.

6. A high frequency coaxial cable as claimed in claim 5, wherein the apertures of the row are of substantially circular form.

7. A high frequency coaxial cable as claimed in claim 1, wherein the longitudinally extending row of apertures is substantially parallel to the longitudinal axis of the cable.

8. A high frequency coaxial cable as claimed in claim 1, wherein the outer conductor is formed of a longitudinally applied, transversely folded tape made at least partly of metal or metal alloy, the apertures of the row being formed in the tape, before the tape is applied to the cable, in such a configuration that when the tape is applied to the insulated inner conductor at least one longitudinally extending row of apertures is provided in the outer conductor with the desired mutual spacing between adjacent apertures.

* * * * *